US007581971B1

(12) United States Patent
Uen

(10) Patent No.: US 7,581,971 B1
(45) Date of Patent: Sep. 1, 2009

(54) BINDING POST

(76) Inventor: Wei-Tang Uen, No. 21, Jingihong Village, Meinong Township, Kaohaiung County (TW)

( * ) Notice: Subject to any disclaimer, the term of this patent is extended or adjusted under 35 U.S.C. 154(b) by 0 days.

(21) Appl. No.: 12/176,449

(22) Filed: Jul. 21, 2008

(51) Int. Cl.
*H01R 27/00* (2006.01)

(52) U.S. Cl. ..... 439/217; 439/551; 439/908

(58) Field of Classification Search ..... 439/217, 439/166, 551, 801, 908
See application file for complete search history.

(56) References Cited

U.S. PATENT DOCUMENTS 4,721,481 A * 1/1988 Grellmann et al. ..... 439/581
5,664,971 A 9/1997 Coy
5,791,919 A 8/1998 Brisson et al.
6,715,899 B1 * 4/2004 Wu ..... 362/655
6,986,680 B2 * 1/2006 Wu ..... 439/551
7,270,561 B2 * 9/2007 Chiu ..... 439/357

* cited by examiner

*Primary Examiner*—Hien Vu
(74) *Attorney, Agent, or Firm*—Alan Kamrath; Kamrath & Associates PA

(57) ABSTRACT

A binding post includes a first conductive member, a second conductive member, an isolating module, a positioning module and a cap. The first conductive member includes a head and a rod coupling to the head. The second conductive member receives the rod of the first conductive member. The isolating module is sandwiched between the first and second conductive members for avoiding electrical connection between the first and second conductive members. The positioning module is for positioning the first and second conductive members relatively to the isolating module. The cap is mounted around the first conductive member and includes a body, a conductive tube between the body and the second conductive member and a hole passing through the body in an axial direction of the body. One end of the conductive tube extends into the hole, and the other end of the conductive tube forms a contacting surface.

8 Claims, 8 Drawing Sheets

BINDING POST

BACKGROUND OF THE INVENTION

1. Field of the Invention

The present invention relates to a connector and, more particularly, to a binding post for terminals of audio electronic equipment to connect with.

2. Description of the Related Art

Conventionally, a loudspeaker has to electrically connect with a plurality of audio lines from an amplifier through a plurality of conventional binding posts, so that audio signals generated by the amplifier can be transmitted to the loudspeaker. Referring to FIG. 1, a conventional binding post 9 used for a loudspeaker includes a threaded metal rod 91 with one end thereof attaching a lead 911 of the loudspeaker and a cap 92 screwing on the other end of the threaded metal rod 91. A first annular plate 912 is formed on and radially extends from the outer surface of the threaded metal rod 91. The cap 92 includes an insulating body 921, a through hole 922 with two ends thereof being arranged at two opposite sides of the insulating body 921, and a conductive tube 923 received in the through hole 922. A second annular plate 924 is formed at one end of the conductive tube 923 and radially extends from the outer surface of the conductive tube 923, with the second annular plate 924 being outside the insulating body 921. Furthermore, there is a thread on an inner surface of the conductive tube 923, which corresponds to that of the threaded metal rod 91 for the cap 92 to be screwed on the threaded metal rod 91 through the conductive tube 923.

However, every conventional binding post can only be used to connect to one audio line, with an end of the audio line being sandwiched between the first and second annular plates 912 and 924. Therefore, four conventional binding posts will be needed for the loudspeaker if there are four audio lines. Besides, when an amount of the binding posts connected to the loudspeaker is more than that of the audio lines of the amplifier, jumpers are used for connections between two of the binding posts that both connect to anodes or cathodes of the loudspeaker. For example, referring now to FIG. 2, the amplifier provides a pair of audio lines, that is a positive line 100 and a negative line 200, while the loudspeaker 300 has four binding posts 9 with two of them connecting to anodes of the loudspeaker and the other two connecting to cathode thereof. The positive line 100 can only electrically connect to one of the two binding posts 9 connecting to anodes of the loudspeaker, and the other one should connect to the binding post 9 connected with the positive line 100 by a jumper 310. Similarly, the way to connect the negative line 200 with the two binding posts 9 connecting to cathodes of the loudspeaker is the same. Nevertheless, use of the jumpers 310 increases additional connecting points in transmission, and, thus, impedance and quality of each jumper 310 may lower the timbre of sounds generated by the loudspeaker. Besides, the jumpers 310 in small size being easily lost by a user and deformation of the jumpers 310 easily caused by external force may both lead to inconvenience of using.

SUMMARY OF THE INVENTION

The primary objective of this invention is to provide a binding post that can be connected to an audio line or simultaneously to two audio lines without jumpers.

A binding post in accordance with an aspect of the present invention comprises a first conductive member, a second conductive member, an isolating module, a positioning module and a cap. The first conductive member includes a head and a rod coupling to the head. The second conductive member receives the rod of the first conductive member. The isolating module is sandwiched between the first and second conductive members for avoiding electrical connection between the first and second conductive members. The positioning module is for positioning the first and second conductive members relatively to the isolating module. The cap is mounted around the first conductive member and includes a body, a conductive tube between the body and the second conductive member and a hole passing through the body in an axial direction of the body, with one end of the conductive tube extending into the hole and the other end of the conductive tube forming a contacting surface.

According to the above description, the present invention provides the binding post having two independent conductive members and which is able to connect to one or two audio lines at the same time. Besides, the cap can be mounted on the second conductive member through any one of the two ends thereof and fixes the audio lines. Consequently, the amount of the required binding posts is reduced to enhance convenience of using the binding post, and lowered timbre and lost jumpers are avoided.

Further scope of the applicability of the present invention will become apparent from the detailed description given hereinafter. However, it should be understood that the detailed description and specific examples, while indicating preferable embodiments of the invention, are given by way of illustration only, since variations will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
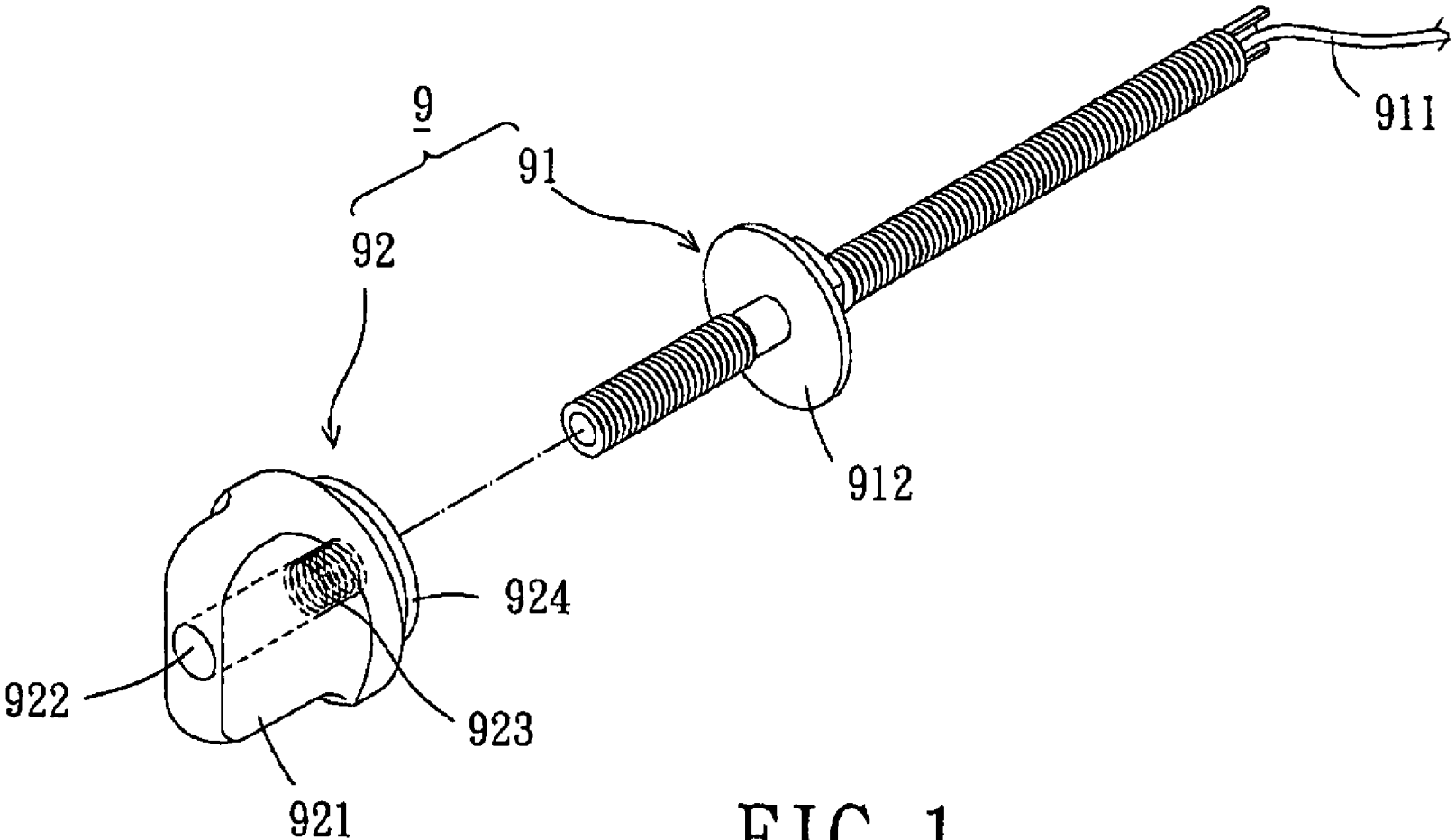
FIG. 1 PRIOR ART
FIG. 1 is an exploded perspective view illustrating a conventional binding post.
Figure 2:
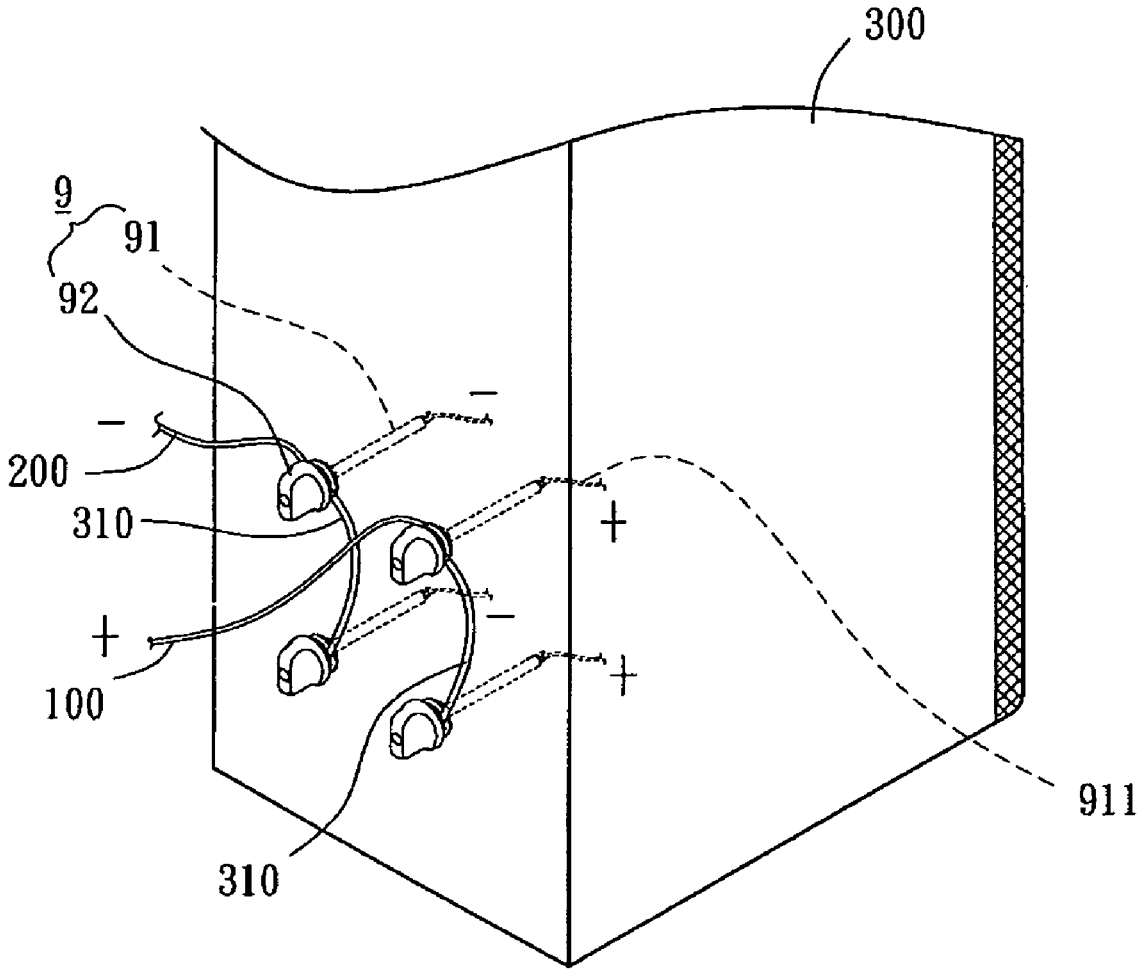
FIG. 2 PRIOR ART
FIG. 2 is a perspective view illustrating the linkage between a loudspeaker and two audio lines through four conventional binding posts.

A binding post of a preferred embodiment according to the preferred teachings of the present invention is shown in FIGS.

3 and 4 of the drawings. According to the preferred embodiment form shown, the binding post includes a cap 1, a first conductive member 2, a second conductive member 3, an isolating module 4, a positioning module 5 and a fixing module 6. The cap 1 includes a body 11 made of insulating material, a conductive tube 12 between the body 11 and the second conductive member 3, and a hole 13 passing through the body 11 and the conductive tube 12 in an axial direction of the body 11. A thread 121 is formed on a surface of the conductive tube 12 facing the hole 13. One end of the conductive tube 12 close to the body 11 extends into the hole 13, and the other end of the conductive tube 12 forms a contacting surface 122 facing the second conductive member 3.

Figure 4:
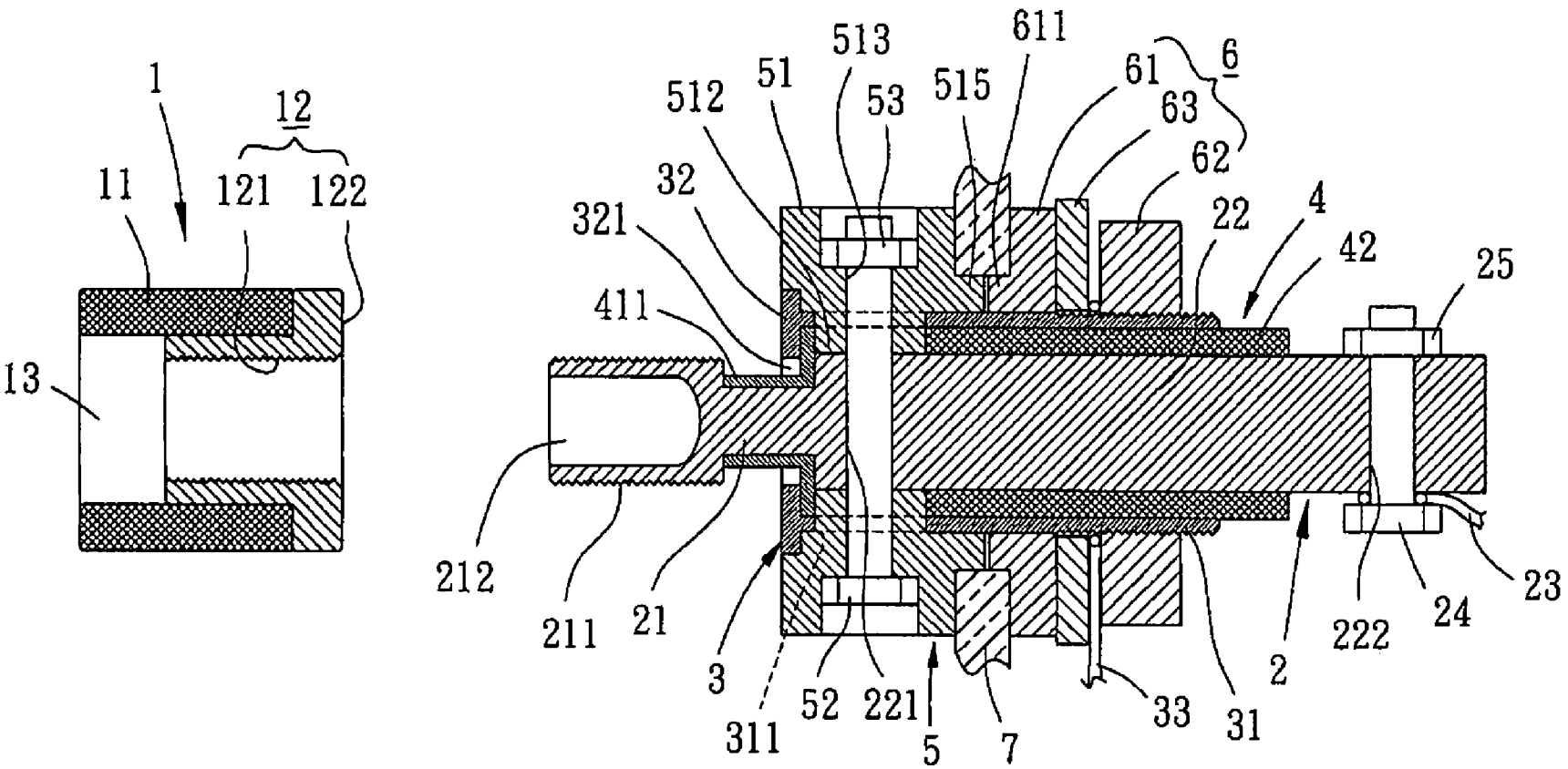
FIG. 4 is a cross sectional view illustrating the binding post in accordance with the preferred embodiment of the present invention.

The first conductive member 2 includes a head 21 and a rod 22 coupling to the head 21. A thread 211 is radially formed on an outer surface of a free end of the head 21 for being received in the hole 13 of the cap 1 and engaged with the thread 121 of the conductive tube 12. Furthermore, said free end of the head 21 preferably has a plugging hole 212 aligning with the hole 13 of the cap 1 for a terminal to plug into the plugging hole 212 through the hole 13 of the cap 1 to electrically connect with the head 21. The rod 22 has a first through hole 221 and a second through hole 222 near two ends thereof respectively. As shown in FIG. 4, a lead 23 can be fixed on the rod 22 by welding or by a screw 24 passing through the second through hole 222 and firmly mounts on the rod 22 with a nut 25.

The second conductive member 3 receives the rod 22 of the first conductive member 2 but does not contact with the first conductive member 2. Said second conductive member 3 includes a hollow cylinder 31 and an annular plate 32 formed on one end of the hollow cylinder 31, with the annular plate 32 forming an axial hole 321 for the head 21 of the first conductive member 2 to pass through and be outside the second conductive member 3. The hollow cylinder 31 has two holes 311 on the radial wall thereof, which are close to the annular plate 32 and align with the first through hole 221 of the rod 22. Thus, an audio line can be alternatively sandwiched between the annular plate 32 and the body 11 of the cap 1 or the contacting surface 122 of the conductive tube 12.

Figure 3:
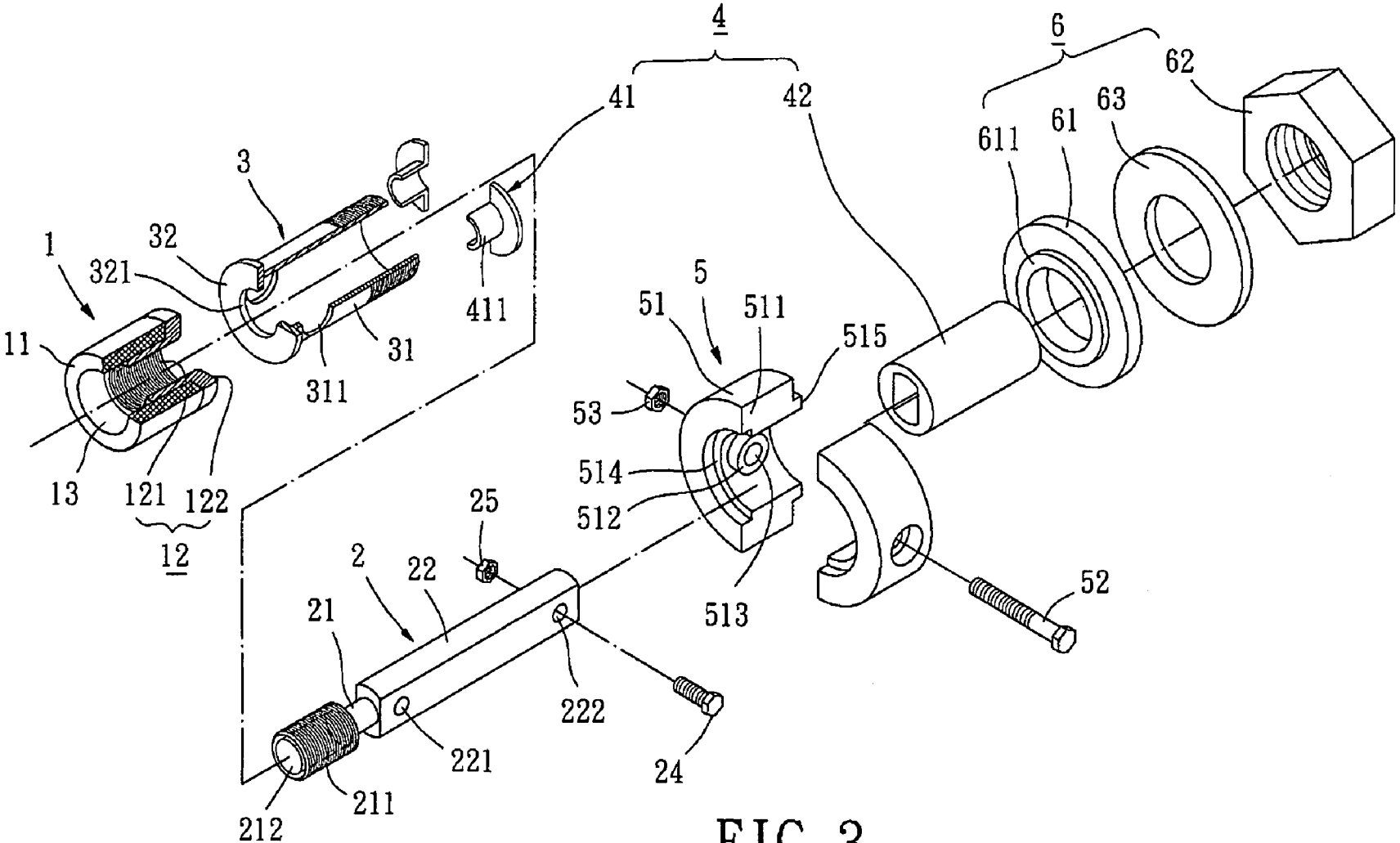
FIG. 3 is an exploded perspective view illustrating a binding post in accordance with a preferred embodiment of the present invention.

Referring again to FIGS. 3 and 4, the isolating module 4 made of insulating materials, such as plastics and rubber, is sandwiched between the first and second conductive members 2, 3 and includes a first insulating sleeve 41 and a second insulating sleeve 42. The first insulating sleeve 41 disposed around the head 21 of the first conductive member 2 and between the thread 211 of the head 21 and the rod 22 separates the head 21 of the first conductive member 2 and the annular plate 32 of the second conductive member 3. Therefore, the audio line alternatively sandwiched between the annular plate 32 and the body 11 or the contacting surface 122 is prevented from electrically connecting with the annular plate 32 and the head 21 at the same time. Moreover, the first insulating sleeve 41 preferably consists of two half bodies 411 to be coupled onto the head 21 from two sides. The second insulating sleeve 42 receives a section of the rod 22 of the first conductive member 2 between the first and second through holes 221, 222 and is sandwiched between the rod 22 and the hollow cylinder 31 of the second conductive member 3. Therefore, electrical connection between the first and second conductive members 2, 3 causing a short circuit is avoided.

The positioning module 5 includes two semi-annular bodies 51, a bolt 52 and a nut 53 all made of insulating materials for further providing an electrical disconnection between the first and second conductive members 2, 3. Two ends of each semi-annular body 51 respectively form two combining surfaces 511 for the two semi-annular bodies 51 to contact with each other to form a complete annular body. Two protrusions 512 are formed on two inner surfaces of the two semi-annular bodies 51 respectively and pass through the holes 311 to abut on the rod 22, with the inner surfaces jointly forming an inner periphery of the complete annular body. Further, two positioning holes 513 respectively extend from an outer periphery of the semi-annular bodies 51 and through the protrusions 512 and align with the first through hole 221. Furthermore, the inner surface of each semi-annular body 51 forms a shoulder 514 close to one side thereof for abutting against the annular plate 32, and a flange 515 extends from an opposite side of the inner surface of each semi-annular body 51. The bolt 52 extends through the positioning holes 513, the holes 311, the first through hole 221, and the nut 53 in sequence, with the nut 53 being screwed onto the bolt 52 to firmly fasten the two semi-annular bodies 51 together, so that the first and second conductive members 2, 3 are positioned relatively to the isolating module 4. Therefore, the first and second conductive members 2,3 are regarded as two independent conductive members of the binding post of the present invention.

The fixing module 6 is mounted around the second conductive member 3 and has a first fixing member 61 with one side thereof forming a flange 611 facing and aligning with the flanges 515 of the two semi-annular bodies 51 for abutting against and fixing a housing 7 of a loudspeaker between the first fixing member 61 and the semi-annular bodies 51. Besides, the fixing module 6 further includes a second fixing member 62 and a spacer 63 between the first and second fixing members 61, 62, with a lead 33 being sandwiched between the second fixing member 62 and the spacer 63 and contacting with the hollow cylinder 31. Therefore, the two independent conductive members of the binding post of the present invention are coupled to the leads 23, 33 respectively. Alternatively, the fixing module 6 can only have the first fixing member 61 and the second fixing member 62 without the spacer 63, with the lead 33 being sandwiched between the first fixing member 61 and the second fixing member 62.

Figure 5:
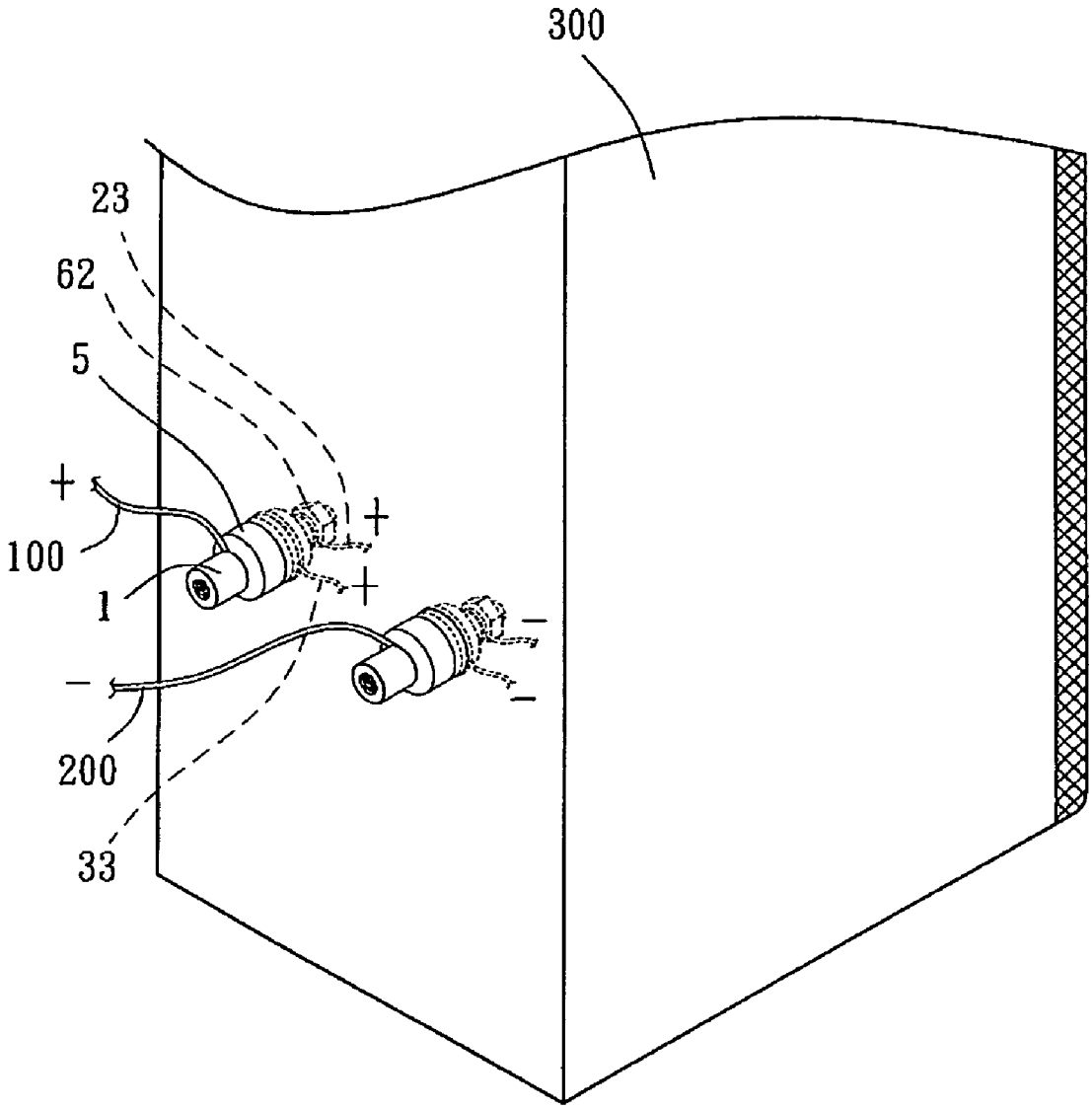
FIG. 5 is a perspective view illustrating the two binding posts in accordance with the preferred embodiment of the present invention connected between a loudspeaker and two audio lines including one positive line and one negative line.
Figure 6:
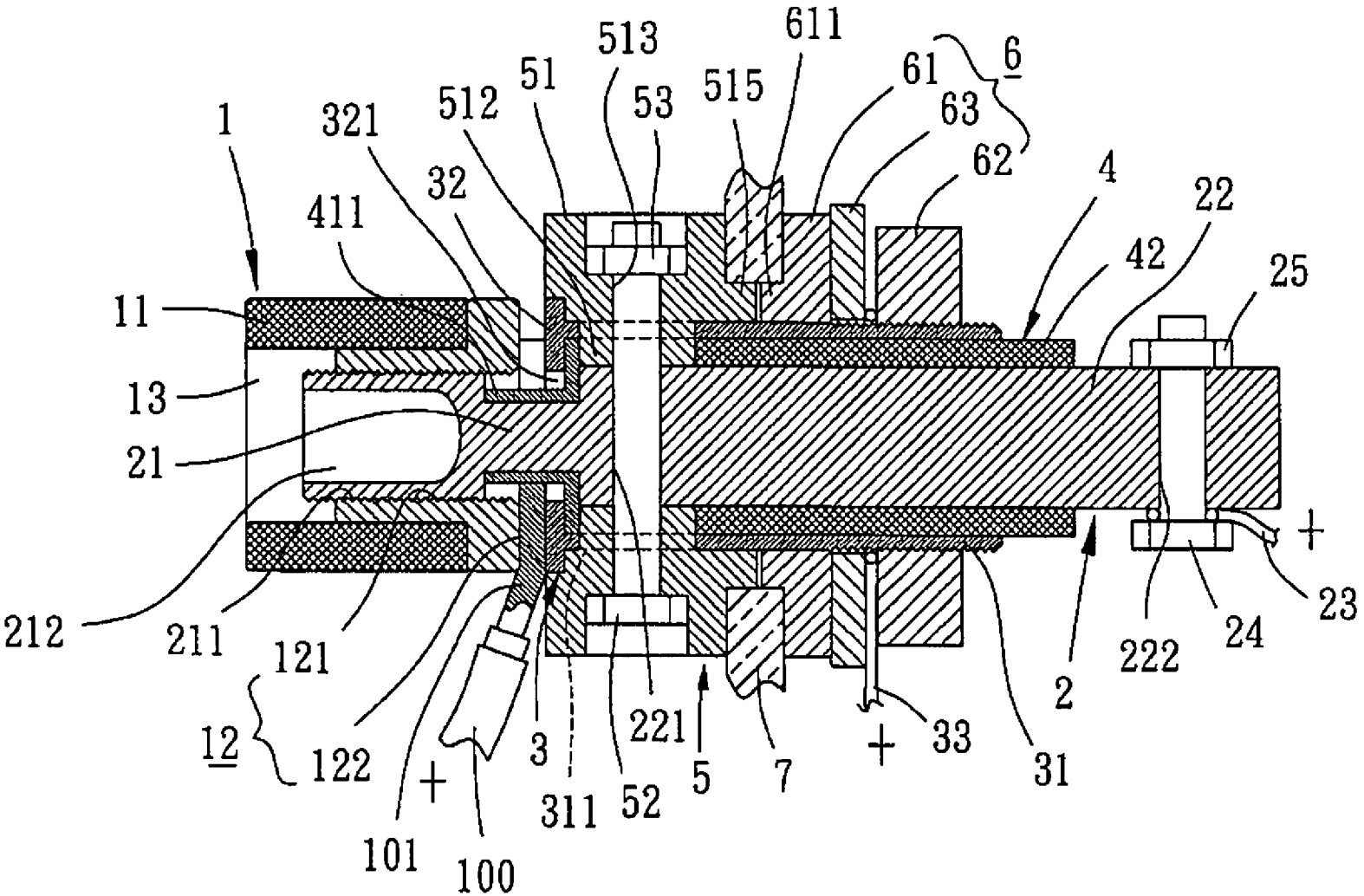
FIG. 6 is a partial, cross sectional view illustrating one of the binding posts connected to one of the two audio lines of FIG. 5.

Referring now to the FIGS. 5 and 6, when two binding posts of the present invention are respectively coupled to a positive line 100 and a negative line 200 for connecting a loudspeaker to an amplifier, each of the positive and negative lines 100, 200 for coupling with the binding posts preferably forms a tongue crimp terminal or a tip terminal. The cap 1 is mounted around the head 21 of the first conductive member 2 with the contacting surface 122 of the conductive tube 12 facing the annular plate 32 of the second conductive member 3. The electrical connection between the positive line 100 and one of the binding posts is shown in FIG. 6, and the electrical connection between the negative line 200 and the other binding post is the same. The tongue crimp terminal 101 of the positive line 100 is sandwiched between and contacts with the contacting surface 122 and the annular plate 32, so as to electrically connect to the first and second conductive members 2, 3. Therefore, the positive line 100 can electrically connect to the leads 23, 33, so that audio signals from the amplifier are transmitted to the loudspeaker through the binding posts of the present invention.

Figure 7:
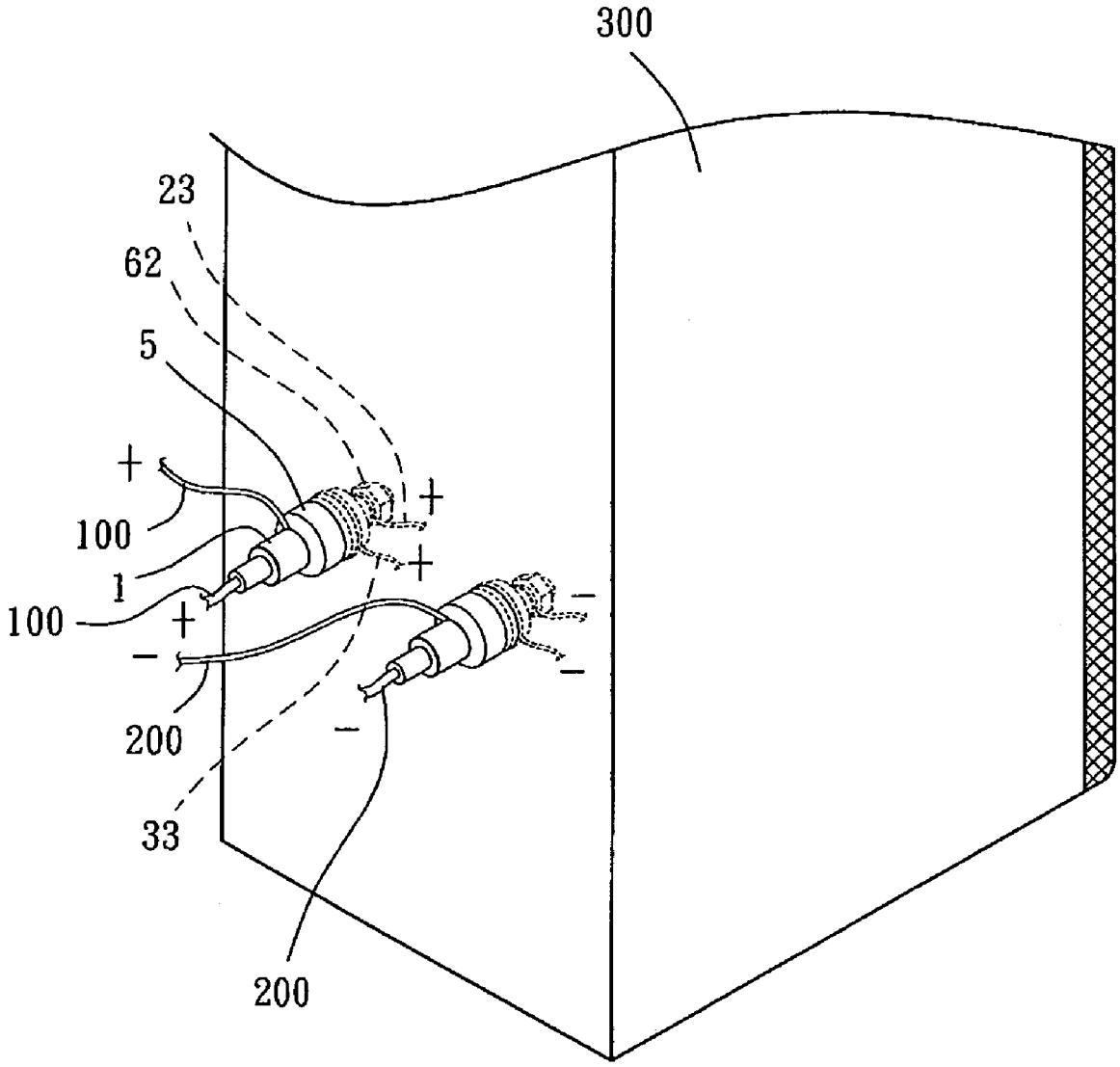
FIG. 7 is a perspective view illustrating the binding post in accordance with the preferred embodiment of the present invention connected between a loudspeaker and four audio lines including two positive lines and two negative lines.
Figure 8:
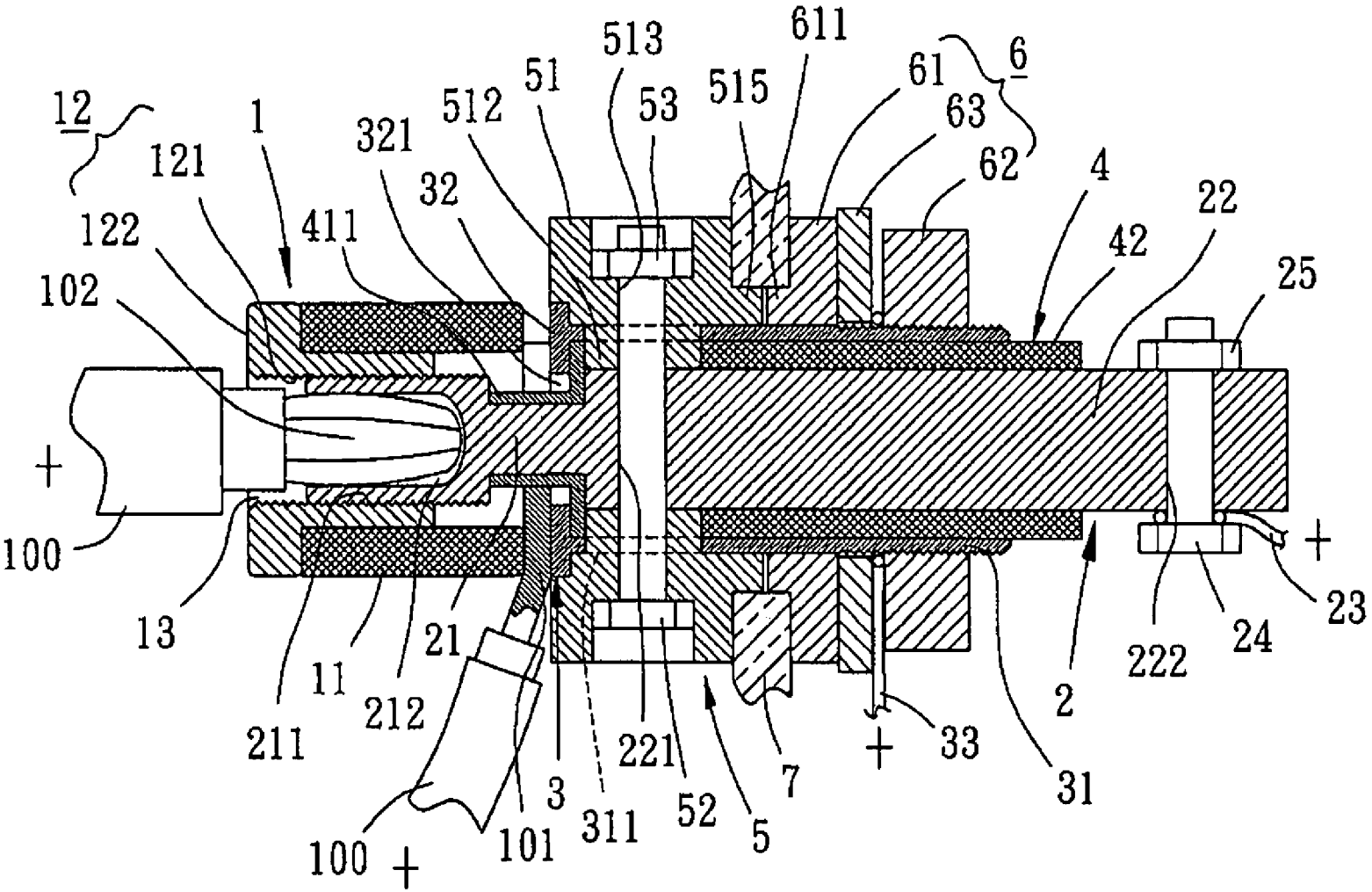
FIG. 8 is a partial, cross sectional view illustrating one of the binding posts connected to the two positive lines of FIG. 7.

Referring now to FIGS. 7 and 8, two kinds of terminals are used when two binding posts of the present invention are respectively coupled to two positive lines 100 and two negative lines 200 for connecting a loudspeaker and an amplifier. For the two positive lines 100, one of them forms the tongue crimp terminal 101 and the other forms a tip terminal 102, as do the two negative lines 200. The cap 1 is mounted around the head 21 of the first conductive member 2, with the body 11 of the cap 1 being beside the annular plate 32 of the second conductive member 3. The electrical connection between the two positive lines 100 and one of the binding posts is shown in FIG. 8, and the electrical connection between the two negative lines 200 and the other binding post is the same. The tongue crimp terminal 101 is sandwiched between and contacts with the body 11 of the cap 1, which is insulated, and the annular plate 32, so as to electrically connect to the second conductive member 3. The tip terminal 102 is plugged into the plugging hole 212 through the hole 13 of the cap 1, so as to electrically connect to the first conductive member 2. Therefore, the two positive lines 100 can electrically connect to the leads 23, 33 respectively, so that audio signals from the amplifier are transmitted to the loudspeaker.

As has been discussed above, the present invention provides the binding post having two independent conductive members 2, 3 to electrically connect with two leads 23, 33, which is able to connect to two audio lines at the same time to reduce the amount of the required binding posts. Further, lowered timbre of the loudspeaker and lost jumpers are avoided, because jumpers are no longer needed. Consequently, convenience of using the binding post is enhanced.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A binding post, comprising:

a first conductive member including a head and a rod coupling to the head;

a second conductive member receiving the rod of the first conductive member;

an isolating module sandwiched between the first and second conductive members for avoiding electrical connection between the first and second conductive members;

a positioning module for positioning the first and second conductive members relatively to the isolating module; and a cap mounted around the head of the first conductive member including a body, a conductive tube between the body and the second conductive member and a hole passing through the body in an axial direction of the body, with one end of the conductive tube extending into the hole and the other end of the conductive tube forming a contacting surface;

wherein the second conductive member includes a hollow cylinder and an annular plate formed on one end of the hollow cylinder, with the head of the first conductive member passing through the annular plate and being outside the second conductive member;

wherein the hollow cylinder of the second conductive member has two holes on the radial wall thereof and the positioning module includes two semi-annular bodies, with two protrusions being formed on two inner surfaces of the two semi-annular bodies respectively and passing through the holes to abut against the rod.

2. The binding post as defined in claim 1, wherein the isolating module includes a first insulating sleeve separating the head of the first conductive member and the annular plate of the second conductive member.

3. The binding post as defined in claim 2, wherein the isolating module includes a second insulating sleeve receiving a section of the rod of the first conductive member and sandwiched between the rod and the hollow cylinder of the second conductive member.

4. The binding post as defined in claim 1, wherein the rod of the first conductive member has a first through hole, and wherein two positioning holes respectively extend from an outer periphery of the two semi-annular bodies and through the two protrusions and align with the first through hole, with a bolt extending through the two positioning holes and the first through hole.

5. The binding post as defined in claim 1 further comprising a fixing module mounted around the second conductive member, wherein the fixing module includes a first fixing member and a second fixing member, with a lead being sandwiched between the first fixing member and the second fixing member and electrically connecting with the second conductive member.

6. The binding post as defined in claim 5, wherein a flange extends from a side of the inner surface of each semi-annular body, and wherein one side of the first fixing member forms a flange facing and aligning with the flanges of the semi-annular bodies for sandwiching a housing between said flanges of the two semi-annular bodies and first fixing member.

7. The binding post as defined in claim 1, wherein the head of the first conductive member has a plugging hole aligning with the hole of the cap for a terminal of an audio line to plug into the plugging hole.

8. The binding post as defined in claim 1, wherein a thread is formed on a surface of the conductive tube facing the hole of the cap, and wherein a thread is radially formed on an outer surface of the head of the first conductive member, with the two threads engaging with each other.

* * * * *